US009474356B2

(12) United States Patent
Garcia Morales

(10) Patent No.: US 9,474,356 B2
(45) Date of Patent: Oct. 25, 2016

(54) OBJECT HOLDER BAND

(71) Applicant: Jose Alberto Garcia Morales, Queretaro (MX)

(72) Inventor: Jose Alberto Garcia Morales, Queretaro (MX)

( * ) Notice: Subject to any disclaimer, the term of this patent is extended or adjusted under 35 U.S.C. 154(b) by 0 days.

(21) Appl. No.: 14/071,800

(22) Filed: Nov. 5, 2013

(65) Prior Publication Data

US 2014/0191002 A1 Jul. 10, 2014

(30) Foreign Application Priority Data

Jan. 9, 2013 (MX) ..... MX/a/2013/000342

(51) Int. Cl.
*A45F 3/14* (2006.01)
*A45F 3/04* (2006.01)
*A45F 5/00* (2006.01)

(52) U.S. Cl.
CPC . *A45F 3/14* (2013.01); *A45F 3/04* (2013.01); *A45F 5/00* (2013.01); *A45F 2003/146* (2013.01)

(58) Field of Classification Search
CPC ..... A45F 3/04; A45F 3/14; A45F 5/00
USPC ..... 224/627, 259, 258, 257, 260
See application file for complete search history.

(56) References Cited

U.S. PATENT DOCUMENTS 776,193 A * 11/1904 Mills ..... 224/602
1,110,694 A * 9/1914 Jennings ..... 224/602
1,290,827 A * 1/1919 Yergason ..... 224/623
2,372,971 A * 4/1945 Moore ..... 224/624
2,624,881 A * 1/1953 Lee ..... 450/89
2,732,111 A * 1/1956 Fogle ..... 224/602
3,884,403 A * 5/1975 Brewer ..... 224/606
3,931,917 A * 1/1976 Zellmer ..... 224/602
4,349,139 A * 9/1982 Oishi ..... 224/257
4,461,411 A * 7/1984 Harrow ..... 224/617
4,634,031 A * 1/1987 Frankhouse ..... 224/602
4,722,464 A * 2/1988 Wright ..... 224/602
5,307,967 A * 5/1994 Seals ..... A45F 3/14 224/257
5,360,149 A * 11/1994 Lucot ..... 224/257
D364,270 S * 11/1995 Kellerman ..... D3/218
D365,928 S * 1/1996 Sauer ..... D3/224
5,551,081 A * 9/1996 Starnes ..... A41D 13/0512 2/468
5,692,661 A * 12/1997 Kellerman ..... 224/648
5,718,364 A * 2/1998 McDowell ..... 224/603
D432,300 S * 10/2000 Vazquez ..... D3/232
6,311,336 B1 * 11/2001 Gootrad ..... 2/251
6,443,347 B1 * 9/2002 Elizalde et al. ..... 224/626
6,446,849 B1 * 9/2002 Schleifer ..... A43B 5/0425 224/258
6,644,527 B1 * 11/2003 Karenga ..... 224/602
6,648,191 B2 * 11/2003 Giggleman ..... A45F 3/14 224/254
6,790,201 B2 * 9/2004 Meyer ..... 604/345
6,886,726 B1 * 5/2005 O'Hare ..... 224/576
6,889,834 B2 * 5/2005 Ho ..... 206/373
D505,787 S * 6/2005 Vaughn ..... D3/224
6,923,357 B2 * 8/2005 Smith ..... 224/605
6,983,870 B2 * 1/2006 Hancock ..... A45F 3/14 224/258
D538,036 S * 3/2007 Buck ..... D3/224
7,870,982 B2 * 1/2011 Dong et al. ..... 224/257

(Continued)

*Primary Examiner* — Justin Larson
*Assistant Examiner* — Lester L Vanterpool
(74) *Attorney, Agent, or Firm* — Hoglund & Pamias, PSC; Roberto J. Rios

(57) ABSTRACT

The present product is designed to carry personal objects in a safety way, such as cell phones, documents, identity cards, keys, money; while moving. It allows to have total control as well as to access them at any time.
It adjusts to the body in an ergonomic way allowing the person feel free to move in any position.

17 Claims, 6 Drawing Sheets

(56) References Cited

U.S. PATENT DOCUMENTS

| | | | | |
|---|---|---|---|---|
| D661,484 | S * | 6/2012 | Hamra | D3/224 |
| 8,225,973 | B1 * | 7/2012 | Bellinson | 224/602 |
| 8,292,521 | B2 * | 10/2012 | Chamberlayne | 396/423 |
| 8,807,410 | B2 * | 8/2014 | Zielberg et al. | 224/604 |
| 2003/0173390 | A1 * | 9/2003 | Smith | A01K 97/06 224/604 |
| 2009/0188959 | A1 * | 7/2009 | Crawford | 224/625 |
| 2010/0133310 | A1 * | 6/2010 | Menzel et al. | 224/602 |
| 2010/0193557 | A1 * | 8/2010 | Clinton et al. | 224/576 |
| 2012/0055969 | A1 * | 3/2012 | Zielberg et al. | 224/614 |

* cited by examiner

FIGURE 1
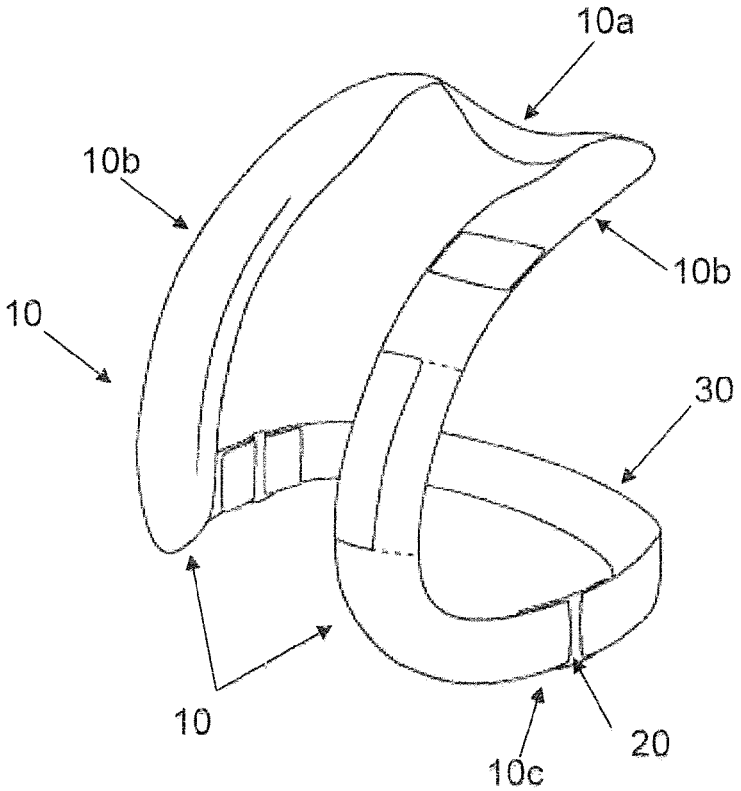
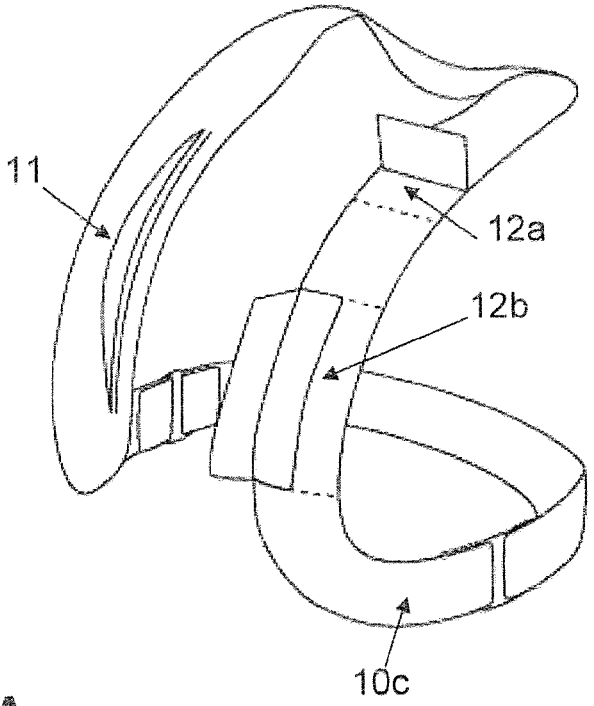
FIGURE 1A

FIGURE 1B
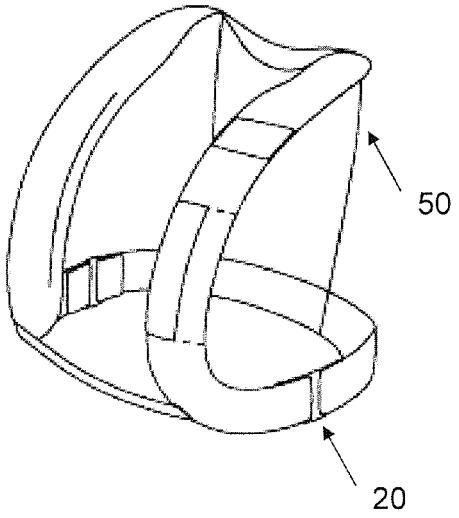
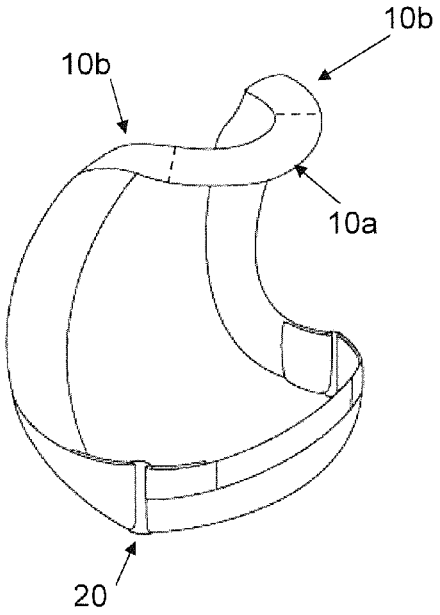
FIGURE 2

FIGURE 2A
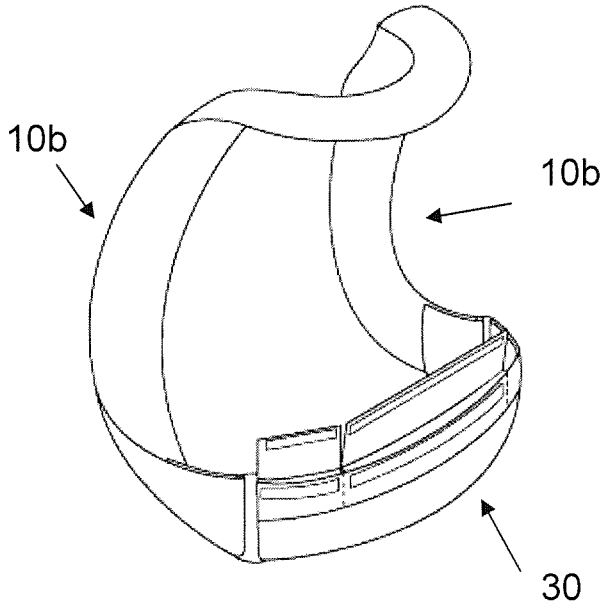
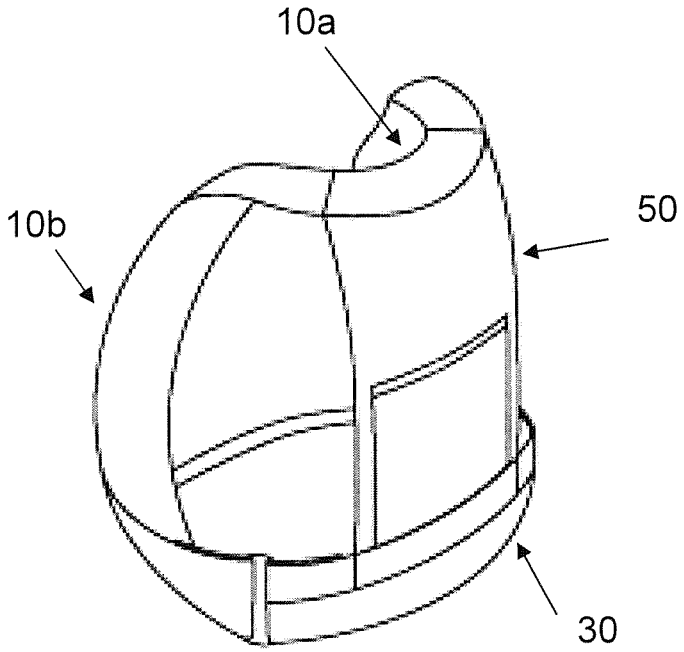
FIGURE 2B

OBJECT HOLDER BAND

INTRODUCTION

When you are travelling, doing exercise or moving is necessary to carry personal, safety and accessible objects to be used at any moment. Although there are many products that may contain said objects, most of the time is not easy to have them at hand in the right moment or such products come out to be a nuisance, have more than enough or are heavy for the purpose they were done.

Therefore, the Object Holder Band was designed to give a solution to an actual need within a world that each time is more active and demanding. Besides, it has the purpose of integrating the user physically as well as during the development of its daily activities.

INVENTION TECHNICAL FIELD

The present invention is a band that adapts to the human body and is used to carry personal objects when doing exercise, traveling or carrying out daily activities.

INVENTION OBJECTIVE

The invention objective is to carry out in a safety way, personal items and have access to them in any time in a quick way, without the need of a bag, a briefcase, pack or pockets of the dress or accessories requiring the use of the hands to carry them.

BACKGROUND

Nowadays, and since a few time ago, there are bags used on the back known as "back-packs" that allow holding personal objects. It is a bag which most of the time is opened by a zipper. It has straps that hold up the shoulders. Another example is the belt bag known with many names according to the region, for example in Mexico is known as "cangurera" or in the United States of America as "waist bag" or "belt pack"; this is, a personal object holder for rapid access. One more example is bags used to travel known as fanny bags or safe bags to carry the belongings as well as important documents during a trip and mainly money. They are used inside the clothes.

Technical Problem to be Resolved

Although there are devices to carry items, these present a problem as the term backpack says it; everything is carried on the back and in order to use the device items it is necessary to take it off. Then take out the object to be used, use it and put it back to later continue using it. On one hand, taking items on the back does not let the user have a visual contact all the time; in order to have access, it is necessary to take them away and then find the object, put them again, even more when the person is riding a bicycle, for example, it is practically impossible to be constantly using them.

Regarding the carriers known as "cangurera", everything is mixed making uncomfortable and slow to find any belonging. Moreover, a bulk is formed so that when used to the front, back or to one side of the waist, can be a nuisance, heavy after some time it has been used. On the other hand, discrete devices make difficult to get them in a rapid way and in order to use them it is necessary to be in a private place.

If they are used outside the clothes they are no longer "discrete" above all when something valuable has to be taken with the person.

Other products, while being well designed to carry belongings, they are also nuisance and in some cases uncomfortable plus being an easy target for foreign people. They are products separate from the user, that is, the user does not have all the time its total control.

BRIEF DESCRIPTION OF THE INVENTION

When it is necessary to bring personal objects such as: a cell phone, a wallet, a music recorder, keys, identification cards, coins, a passport, visa, plane or train tickets, a check book, etc. while travelling, doing exercise, running, riding a bicycle, playing golf, skating, weight lifting, etc., or when walking in the city, getting into the subway, bus, airplane, etc. and being able to have access and to take total control of said belongings at all times; this object holder band has been developed to resolve all this. This device adjusts to the body in such a way that leaves to the front in both sides of the chest, the compartment for the personal objects. These are hold up when they are united in the upper part behind the neck and in the lower part of the lumbar zone of the back forming this way a single element. It is used on the clothes and it is hidden whenever a sweater, a vest, a jacket is used so once it is used it can become so discrete that it can be unnoticed due to the clothes.

BRIEF DESCRIPTION OF THE FIGURES

FIG. 1 shows the frontal perspective view of the object holder band in a first modality;

FIG. 1A shows the frontal perspective view of object holder band in a second configuration of the first modality;

FIG. 1B shows the frontal perspective view of the object holder band in a second modality;

FIG. 2 shows the back perspective view of the object holder band in a first configuration of the first modality;

FIG. 2A shows the back perspective view of the object holder band of the first modality in a second configuration;

FIG. 2B shows the back perspective view of the second modality de object holder band in a first configuration;

SUMMARY

The object holder band is an invention in which the user can carry personal objects, accessible in a safety way. Usually, when doing any sports as running, riding a bicycle, skiing, etc., it is difficult to carry belongings such as a cell phone, music recorder, etc.; but above all to have access to those belongings without getting distracted. Likewise, when traveling it is necessary to have at hand a passport, visa, tickets, identification cards, any foreign currency, etc. This limits the access and consumes time by when trying to find an item. In the same way, in alternate products, while having some divisions; the belongings and this type of products are also loose elements, that is, they can become a nuisance since in order to sit or rest, it is necessary to remove them and then put them back. The object holder band is designed with two main pieces and a third one uniting the first two; and also has 2 accessories, one for frontal hold-up and safety and a container to store objects of bigger dimensions. The concept is wearing light clothing, without carrying anything in the clothes or in another container, but carrying everything in this invention that allows having the absolute and concentrated control of all the belongings. Unlike the referred products in the background, the object holder band is integrated to the body without bulking the user and the weight of what is being carried can be distributed in an equal manner.

DETAILED DESCRIPTION OF THE INVENTION

Figure 3:
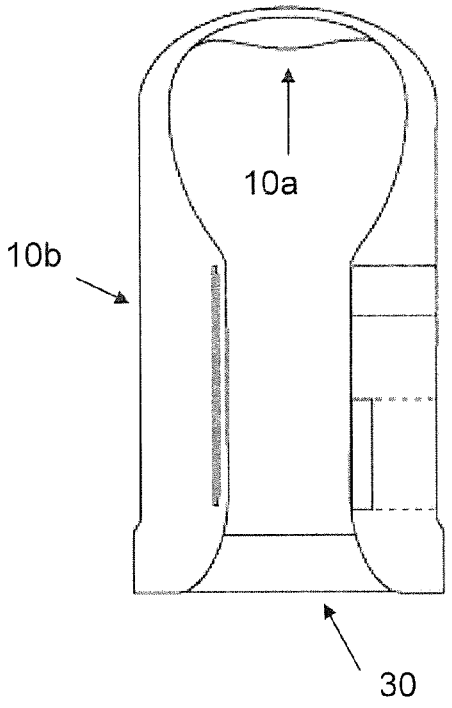
FIG. 3 shows a frontal view of the frontal object holder band.
Figure 4:
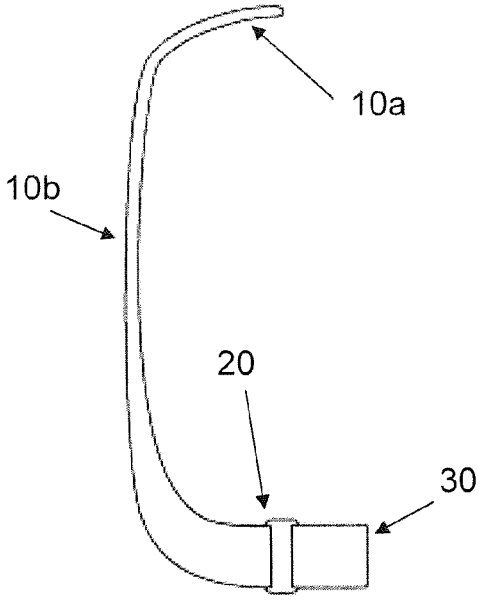
FIG. 4 shows a left side view of the object holder band, substantially equal to the right side view.

The present invention is referred to an object holder band as the one shown in FIG. 1, FIG. 3 and FIG. 4, consisting of a frontal belt (10) some tying means (20) and a lumbar belt (30).

The frontal belt (10) is a sole elongated body where different zones are defined by diverse thicknesses and axial as well as longitudinally foldings. One of these zones is the collar pad (10*a*); it is an object with an appropriate material avoiding lacerations to the neck of the bearer having a semicircular form, but that also can change into a more comfortable geometry when it is put on the back of the neck at the cervical vertebra zone of the trapezium muscle and shoulders of the user, in such a way that in the same use there is an arch form configuration in one direction at half the length of the frontal belt (10) and the ends in an arch form, in the opposite direction when they are located on the shoulders of the bearer forming straps (10*b*), as it is observed in FIG. 1.

Another zone of the frontal belt are the straps (10*b*), consisting of a pair of elongated vertical bodies defining a right frontal strap and a left frontal strap, where each one of them is united at its upper end with the opposite ends of the collar pad (10*a*) as it is shown in FIG. 2; moreover, these straps (10*b*) have in their lower ends, tying elements (20) known as buckles or means for bonding and hooking straps or belts known as VELCRO®. Throughout said straps (10*b*) there is a series of pockets with closing elements such as tongues or lapels, said closing elements with sealing means such as VELCRO®, buttons, zippers or clasps and similar ones. Placement of the pockets in the frontal straps can be adjusted to the user's needs. By way of illustration, the different elements may have an arrangement, for example: on the frontal face and next to the right side end of one of the frontal straps (10*b*) a general compartment/pocket can be found (11) consisting of an elongated and vertical housing according to the strap length (10*b*) where it is located. On the front face and next to the right lateral edge, a vertical opening and closing means like a zipper is provided, but that can also be changed into buttons, VELCRO® straps, buckles, laces or any means that allows containing safety belongings in a closed configuration as it is shown in FIG. 1 and having an open configuration as it is shown in FIG. 1A. Internal compartments can be found (not illustrated) within the general compartment (11), with horizontal access and arranged in a vertical alignment; optionally it can have combinations allowing to vary the number of internal compartments (not illustrated) and the vertical access type as well as containing lids as lapels with openings and closing means like VELCRO® contact straps, buttons, zippers or other similar means that helps to secure the belongings. Likewise, the lids can change into a geometry that allows containing the belongings.

On the front face and substantially centered on another of the straps (10*b*) there are compartments vertically distributed through this strap (10*b*); an upper compartment (12*a*) with horizontal opening and closing like a lapel with VELCRO® straps; below there is a left bottom compartment (12*b*), with a vertical opening and closing in the left internal-lower end as a lapel or tongue with VELCRO® like straps at the edges, as shown in FIG. 1A. Both compartments (12*a*) and (12*b*) may change in amount and way of access form and contain opening and closing means of buttons, zippers, laces or other means that helps to secure the belongings stay together. Likewise, they can change its rectangular form to hexagonal, pentagonal or any other geometry that allows containing the belongings. In the lower part, of the straps (10*b*) change from a descending straight geometry to a curve generating a horizontal section (10*c*), to be located in the lateral part of the users back as shown in FIG. 7A; tying means can be found (20) in the free end of these horizontal sections (10*c*), that for illustrative purposes will be described as buckles (21). These elements are found between the material, at the middle part, between the external part and the internal one being hidden from simple view as it is known in the prior art. Each buckle (21) is internally held with its respective (10*b*) strap.

Each strap end (10*b*) in the internal part that is in contact with the body, have VELCRO® like straps, being positioned first on a section with the part that contains hooks and in second place and to all the center a section with the part that contains padlocks or flush.

Figure 6:
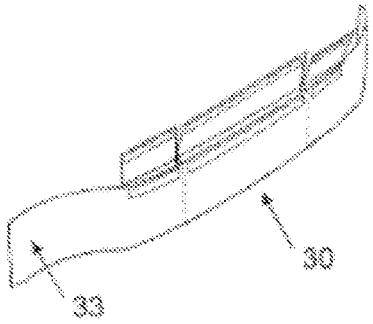
FIG. 6 shows a back perspective detailed view of a lumbar belt of the object holder band in a second configuration.

The lumbar belt (30) is an elongated body as shown in FIG. 2, FIG. 3 and FIG. 6, that can have rear compartments (31); as an example, three compartments can be provided: a central one (31*a*) and two side ones (31*b*) horizontally positioned, with lapel-like opening and closing to form a housing which can be accessed once these lapels are opened as shown in FIG. 6; having VELCRO® like straps which can change in number, access type, orientation and contain opening and closing means such as buttons, zippers, laces and other means that helps to securely contain belongings and combinations of the same. Likewise, they can change their rectangular form to a hexagonal, triangular, pentagonal or any other geometry that allows containing the belongings.

Each end of the lumbar belt (30) has in its internal part VELCRO® like straps, in first place a section with cloth containing hooks and in second place and to the center, a section with cloth containing padlocks or plush.

Optionally, the compartments of this object holder band may have no lapels to allow a fast access, which will depend on the needs and requirements of the user or they may be equally removable.

Figure 5:
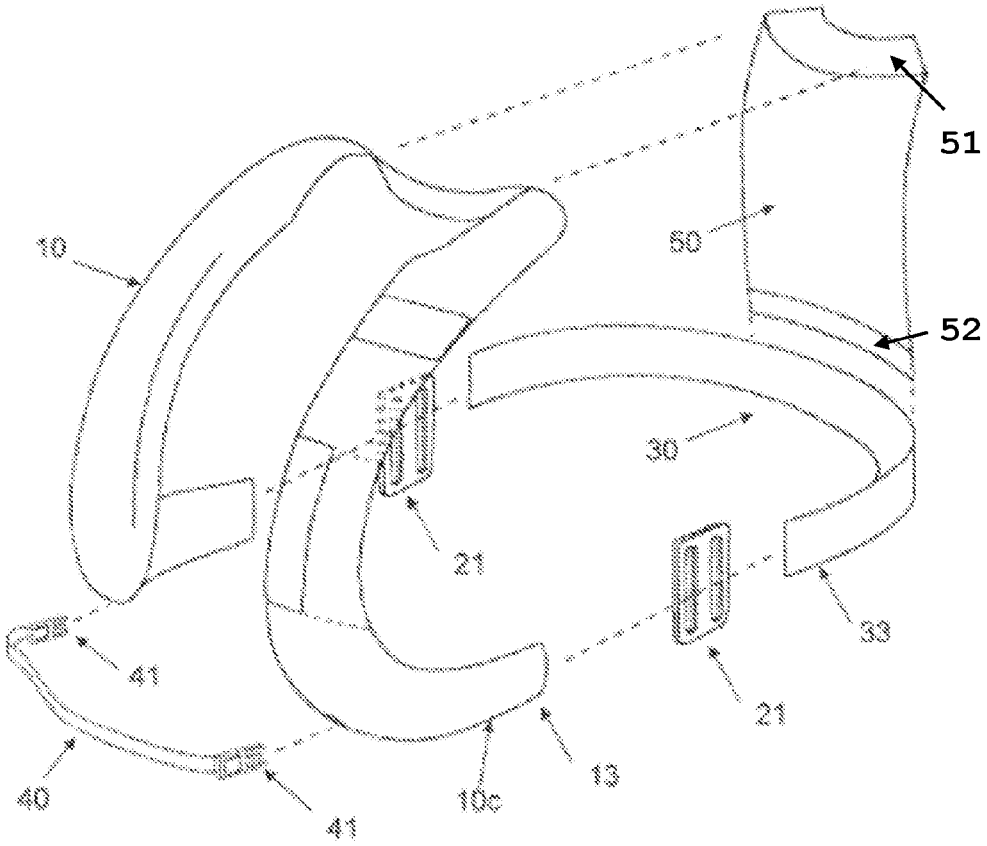
FIG. 5 shows a perspective view in frontal detail drawing of the second modality of the object holder band.

The union element (20) between the frontal belt (10) and the lumbar belt (30) can be a commercial path buckle (21) of general use but can also change to buttons, zippers, laces or any other means that allows both pieces to be united. On one side of said buckle (21) a hold-up strap (13) is passed consisting of an extension of the lower end of the straps (10*b*) which has a hold-up means (not illustrated) of VELCRO®-like strap but can also be changed into buttons, zippers, laces or any other means allowing to hold up and adjust the desired size. From the other side of the buckle (21) a hold-up end (33) is passed consisting of one extension of the distal ends of the lumbar belt (30) as shown in FIG. 5, which has hold-up means (not illustrated) with VELCRO® straps but can also be changed to buttons, zippers, laces or any other means allowing to hold up and adjust the desired size.

The object holder band has two accessories, an elastic strap (40) and a rear bag (50), as shown in FIG. 2B. The elastic strap (40) is a piece of elastic material having on each end a first clasp component (41) of a union element like a clasp to connect with the second clasp component (not illustrated) located in the internal part of the straps (10*b*) in the transition curve connecting with the horizontal sections (10*c*) which will be located on each side of the user's torso as shown in FIG. 5 and FIG. 7A. These clasp elements may be changed by other types of buttons, zippers, laces or any other that allows the frontal straps to be firm (10*b*) and (10*c*). The rear bag (50) is an accessory to store belongings of larger size having an upper union section (51), in such a way that in the upper face a first component of a tying means (not illustrated) is found that can be like the one known as VELCRO®, so it joins the lower face of the collar pad (10*a*) since this face has a second component of the tying means (not illustrated); on the other hand, the lower end of the rear bag (50) has a union lower section (52) so that in the external face there is a first component of a tying means (not illustrated) that can be like the one known as VELCRO®, so it joins to the internal face of the lumbar belt (30) since in this face there is a second component of the tying means (not illustrated), in such a way that an assembly is created as shown in FIG. 2B. The joining of the rear bag (50) with the collar pad (10*a*) and with the lumbar belt (30) can be with union elements like Velcro® but can be changed to buckle, buttons, zippers, laces or any other means that allows keeping together both parts if desire and to conveniently separate them as well. The rear bag (50) has rectangular form, an opening and closing means of elastic type horizontally positioned but can also be changed to zipper, buttons, VELCRO® straps, laces or any other means allowing access to the belongings to keep them safe. Likewise, its size can change to dimensions or the number of compartments depending on the needs.

A Better Way to Carry Out the Invention

Figure 7:
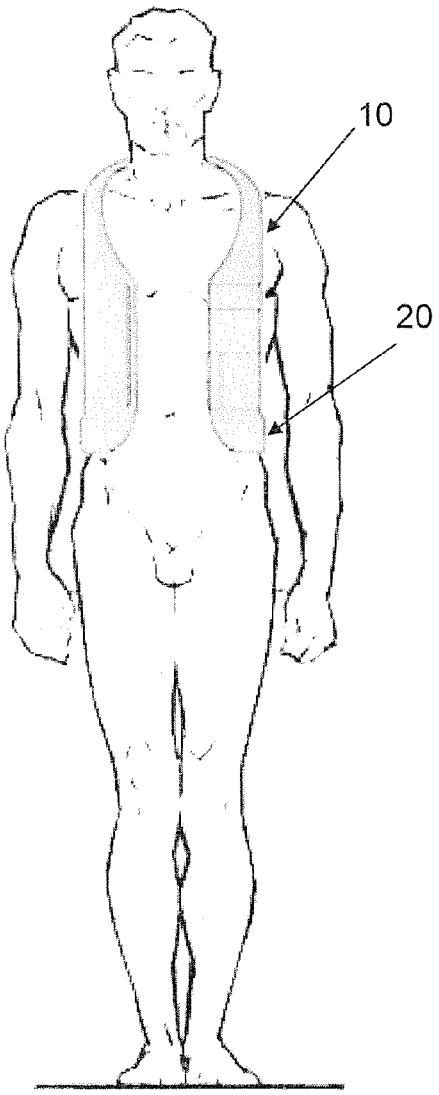
FIG. 7 shows a frontal schematic view of the mode of use of the object holder band.
Figure 7A:
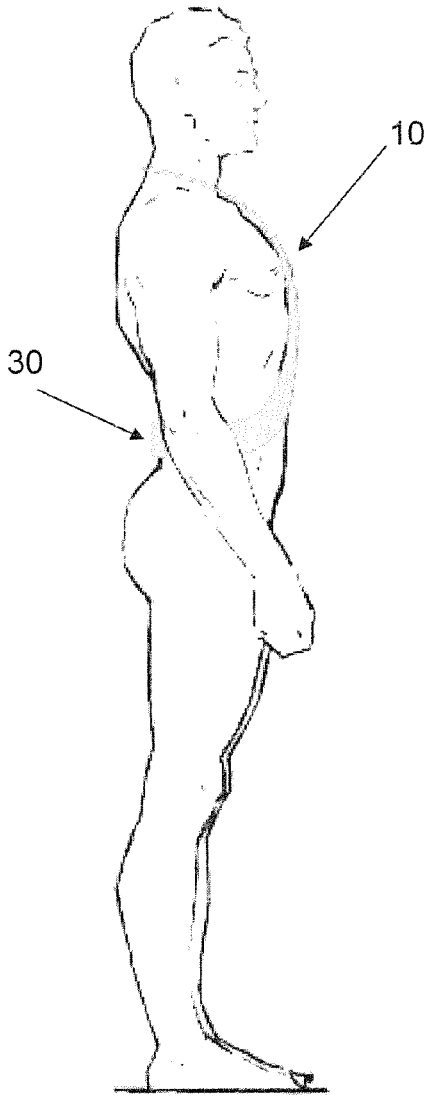
FIG. 7A shows a schematic side view of the mode of use of the object holder band.

In use as shown in FIG. 7 and FIG. 7A, the collar pad (10*a*) is placed in the rear part of neck, projecting the user's arms on the rear face of the straps (10*b*) so that the pockets located inside them are within reach and sight of the user. Therefore, the position of the strap (10*b*) allows the lumbar belt to settle down (30) in the lumbar zone of the back, providing support to the user and when there are objects stored in the pockets avoiding dislocation of the object holder band. Once the object holder band is placed as it has been described, the length of the hold-up strap (13) of each one of the straps (10*b*) is adjusted in the tying means (20), as well as in the hold-up end (33) of the lumbar belt (30), to adjust the position of the object holder band; afterwards, an elastic band is secured (40) with the clasp elements (41), to offer structural rigidity to the component. With this, the rear bag (50), if used, shall have a support to allow assembling to the band if necessary, since there is an element offering tension resistance to the load of the objects stored within.

The invention claimed is:

1. An object-holder band comprising:

a frontal belt (10) formed as a sole elongated body having an arc-shaped collar pad (10*a*) defined at a middle portion of said sole elongated body and configured to be positioned around the neck of a user, the ends of said collar pad (10*a*) being pre-formed in an arch configuration having downward curved ends so that said sole elongated body provides first and second straps (10*b*), at an angle with respect to said collar pad (10*a*), configured to longitudinally extend over the torso of said user, at least one storage element provided along the length of said first and second straps (10*b*), wherein an end of said first strap (10*b*) comprises a first end of said sole elongated body and an end of said second strap (10*b*) comprises a second end of said sole elongated body, both first and second ends of the sole elongated body having a curved-shape portion (13) pre-formed as backward curved ends having horizontal sections (10*c*) extending towards a lumbar region of said user at an angle with respect to said first and second straps (10*b*);

a sole lumbar belt (30), separate and removable from said frontal belt (10), having a first end and a second end; and first coupling means (20) removably coupling the end of said first strap (10*b*) to the first end of said removable lumbar belt via said curved-shape portion (13) and a second coupling means (20) removably coupling the end of said second strap (10*b*) to the second end of said removable lumbar belt via said curved-shape portion (13).

2. The object-holder band of claim 1, wherein said at least one storage element includes a closing element preventing access to said at least one storage element.

3. The object-holder band of claim 2, wherein said closing element is a flap.

4. The object-holder band of claim 2, wherein said closing element comprises one of: hook-and-loop elements, buttons, zippers and clasps.

5. The object-holder band of claim 3, wherein said flap comprises one of: hook-and-loop elements, buttons, zippers and clasps.

6. The object-holder band of claim 1, wherein said lumbar belt comprises at least one storage element.

7. The object-holder band of claim 6, wherein the at least one storage element of said lumbar belt includes a closing element preventing access to said at least one storage element of the lumbar belt.

8. The object-holder band of claim 7, wherein the closing element of the at least one storage element of said lumbar belt is a flap.

9. The object-holder band of claim 7, wherein said closing element comprises one of: hook-and-loop elements, buttons, zippers and clasps.

10. The object-holder band of claim 8, wherein said flap comprises one of: hook-and-loop elements, buttons, zippers and clasps.

11. The object-holder band of claim 1, wherein said first and second coupling means (20) comprise a buckle (21).

12. The object-holder band of claim 1, further comprising an elastic element (40) having a first and a second coupling element (41) removably attached to said first and second straps (10*b*), respectively.

13. The object-holder band of claim 1, further comprising a back storage element having a first coupling element positioned at a top portion of said back storage element and a second coupling element positioned at a bottom portion of said back storage element.

14. The object-holder band of claim 13, wherein said first coupling element is removably coupled to said arc-shaped collar pad (10*a*) and said second coupling element is removably coupled to said lumbar belt.

15. The object-holder band of claim 1, wherein the object-holder band is adjusted to fit a user's body by selectively adjusting at least one of: the length of said lumbar belt (30) between said first and second coupling means, and the length of said frontal belt (10) between said first and second coupling means.

16. An object-holder band comprising:

a frontal belt (10) formed as a sole elongated body having an arc-shaped collar pad (10*a*) defined at a middle portion of said sole elongated body and configured to be positioned around the neck of a user, said elongated body being curved at the ends of said arc-shaped collar pad (10*a*) when positioned over the shoulders of the user providing first and second straps (10*b*) configured to longitudinally extend over the torso of said user, at least one storage element provided along the length of said first and second straps (10*b*), wherein an end of said first strap (10*b*) comprises a first end of said sole elongated body and an end of said second strap (10*b*) comprises a second end of said sole elongated body, both first and second ends of the sole elongated body having a curved-shape portion (13) configured to extend towards a lumbar region of said user;

a lumbar belt (30), separate from said frontal belt (10), having a first end and a second end;

first coupling means (20) coupling the end of said first strap (10*b*) to the first end of said lumbar belt via said curved-shape portion (13) and a second coupling means (20) coupling the end of said second strap (10*b*) to the second end of said lumbar belt via said curved-shape portion (13); and a back storage element having a first coupling element positioned at a top portion of said back storage element and a second coupling element positioned at a bottom portion of said back storage element.

17. The object-holder band of claim 16, wherein said first coupling element is removably coupled to said arc-shaped collar pad (10*a*) and said second coupling element is removably coupled to said lumbar belt.

* * * * *